United States Patent [19]

Akers

[11] 4,159,067

[45] Jun. 26, 1979

[54] DISPENSING PUMP FOR CONTAINER

[76] Inventor: Edward G. Akers, 3177 Park La., Apt. 239, Dallas, Tex. 75220

[21] Appl. No.: 803,615

[22] Filed: Jun. 6, 1977

[51] Int. Cl.[2] ..... B67D 5/32

[52] U.S. Cl. ..... 222/153; 222/321; 222/324; 222/384

[58] Field of Search ..... 222/79, 153, 321, 323, 222/324, 340, 332, 341, 379–381, 383, 384, 402.11, 469, 470; 239/333, 526; 417/469

[56] References Cited

U.S. PATENT DOCUMENTS

| | | | |
|---|---|---|---|
| 3,149,757 | 9/1964 | Safianoff | 222/153 |
| 3,471,065 | 10/1969 | Malone | 239/333 X |
| 3,770,167 | 11/1973 | Ewald | 222/153 |
| 3,797,705 | 3/1974 | Cooprider | 222/402.11 |
| 3,814,298 | 6/1974 | Hansen | 222/153 |
| 3,880,313 | 4/1975 | Akers | 215/211 |
| 3,913,841 | 10/1975 | Tada | 222/384 X |

*Primary Examiner*—Robert J. Spar
*Assistant Examiner*—Fred A. Silverberg
*Attorney, Agent, or Firm*—Peter J. Murphy

[57] ABSTRACT

The pump includes components designed for fabrication by high speed injection molding from plastic material, and is adapted for mounting by a suitable closure to a container. The basic components are a base, a head and an actuator. The base provides a sealed closure with the mouth of the container and provides a support barrel for the head. The support barrel also includes structure providing an inlet check valve seat, and for supporting the dip tube. The head includes a body having a dependent support stem for latching engagement with the support barrel, and a laterally projecting hollow plunger for supporting the actuator. The actuator is essentially a hollow barrel received over the plunger to define a variable pumping chamber, having a discharge orifice at its distal end, and having a trigger handle for manipulation and pumping action by the user. A compression spring within the pumping chamber assists in the pumping action. These basic components include coacting structure for latching the plunger in a locked condition where the container can be shipped with the pump assembly attached and leakage is prevented, and wherein the latching structure is designed to inhibit release of the plunger to the pumping position by children. As an accompanying structure, the pump base and container may have coacting structural features for latching the pump assembly to the container in a manner to inhibit removal of the pump assembly from the container by children.

14 Claims, 13 Drawing Figures

DISPENSING PUMP FOR CONTAINER

BACKGROUND AND SUMMARY OF THE INVENTION

This invention relates to a dispensing pump for use with hand held liquid containers; and more particularly to such a pump which can be placed in a locked condition to prevent leakage of liquid and to inhibit operation of the pump by children.

One object of this invention is to provide a dispensing pump for direct application to a variety of forms and sizes of liquid containers.

Another object of this invention is to provide a dispensing pump consisting of a minimum number of parts which may be fabricated from plastic material by high speed injection molding techniques, enabling economic manufacture.

A further object of this invention is to provide a pump for use with liquid containers which can be placed in a locked condition to inhibit or discourage operation of the pump by children.

Still another object of this invention is to provide a dispensing pump for containers which can be placed in a locked condition to enable shipping of filled containers with the pumps attached without leakage of the contents.

A still further object of this invention is to provide a dispensing pump for liquid containers including a closure adapted to coact with the container mouth to inhibit the removal of the pump from the container by children.

Another object of this invention is to provide a dispensing pump for use with containers, wherein the pump includes a closure for mounting in sealed relation to the container and to inhibit removal of the closure from the container by children, and where the pump can be placed in a locked condition to prevent leakage of fluid from the pump to inhibit operation of the pump by children.

A further particular object of this invention is to provide a dispensing pump for use with containers, whereby the pump may be placed in a locking condition to enable shipping of the container with attached pump without leakage, and where the pump is readily released from the locked condition by an adult user for immediate use.

These objects are accomplished in a pump which comprises in combination a base, a head and an actuator. The base comprises a closure for sealing engagement with the mouth of a container, and a central support barrel coaxial with the closure and the container mouth. The head comprises a body, a depending support stem, and an elongated hollow plunger projecting from the body. The body provides an inlet chamber communicating with the support stem; and the hollow plunger communicates with the inlet chamber. The actuator comprises a barrel slidably received over the plunger to provide a variable pump chamber, and provides a discharge orifice at the distal end of the barrel. A spring disposed in the pump chamber urges outward movement of the actuator relative to the head; and the base and actuator having coacting stop means to limit the outward movement of the actuator. Handle means is provided on the actuator for effecting inward movement thereof by the user.

More particularly the pump base, head and actuator have coacting structure to prevent disassembly without removing the pump from the container. Still more particularly the base, head and actuator have coacting structure to latch the plunger in a locked condition relative to the head thereby preventing pumping action; and in a manner to inhibit unlocking the plunger by children. Additionally, coacting structure seals the pump against leakage in the locked condition. Still more particularly the pump closure and container have coacting latching structure to inhibit removal of the pump from the container by children.

The novel features and the advantages of the invention, as well as additional objects thereof, will be understood more fully from the following description when read in connection with the accompanying drawings.

DRAWINGS

DESCRIPTION OF THE PREFERRED EMBODIMENT

Figure 1:
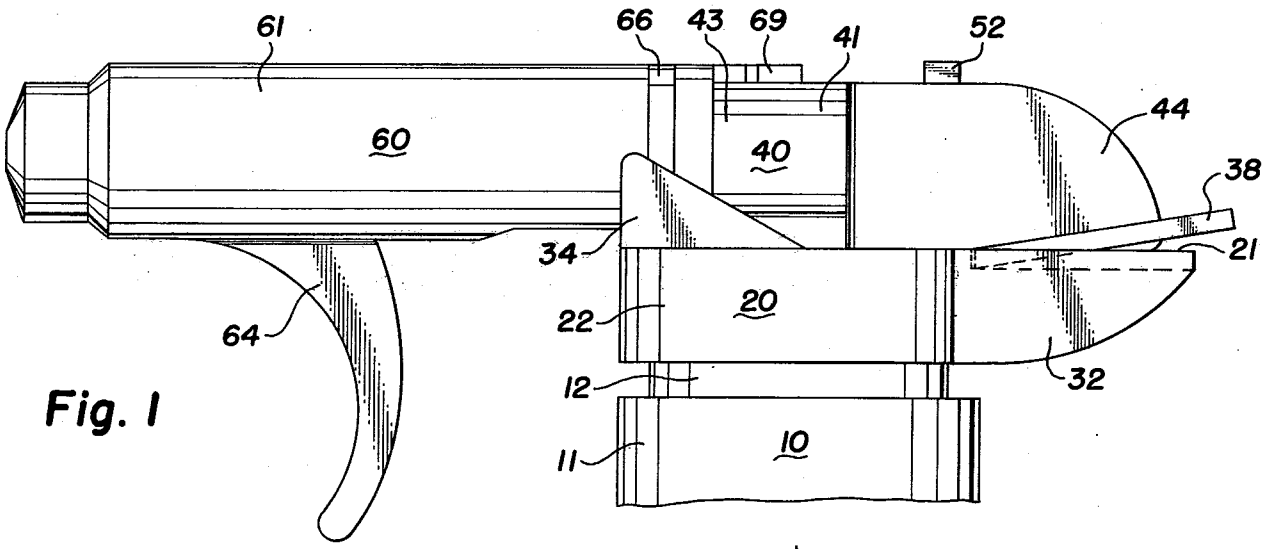
FIG. 1 is a side elevation view of a dispensing pump according to the invention, with a container shown fragmentarily.

The drawings illustrate a preferred form of dispensing pump according to the invention, and also illustrate a particular form of closure for mounting the pump on the neck of a container in a manner to provide a safety latch and seal with the container. The coacting structure of the pump closure and container is the subject of applicant's U.S. Pat. No. 3,880,313 entitled Safety Cap and Container, issued Apr. 29, 1975.

The illustrated pump consists of three principal components namely, a base 20, providing the closure for mounting the pump on a container 10, a head 40 and an actuator 60. These major components, as well as the container and most other components of the pump, are designed to be fabricated from suitable plastic materials by high speed injection molded techniques. The plastics from which these parts may be fabricated include for example polypropylene, styrene, linear polyethylene and acetal copolymer.

The drawings illustrate only the neck 11 of a container 10; and the container may have any desired shape including a reduced diameter neck. The distal portion of the neck includes a generally cylindrical outer wall 12 having angularly spaced latching dogs 13 (four for example) which will be described in detail subsequently.

These latching dogs are adjacent to the lip of the container mouth; and the mouth has a tapered or conical interior wall surface 14 decreasing in diameter from the mouth opening.

The pump base 20 provides a closure for the container 10, which is formed by a top wall 21 and a dependent exterior cylindrical skirt 22. The interior wall of the skirt is provided with angularly spaced latching lugs 23 which coact with the latching dogs 13 in a manner to be described, to secure the base to the container. The base closure includes an additional interior dependent skirt 24, coaxial with the skirt 22, which is relatively thin in cross-section and flexible. This interior skirt coacts with the container tapered wall 14 to perform two functions. One function is a sealing function provided by the relative dimensions, in that the distal end of the skirt 24 has a diameter larger than the smaller diameter of the tapered surface 14. Accordingly, as the skirt is moved axially into the container mouth, it affects a seal with the tapered wall 14. The other function is that, during the effecting of this seal, the lip of this skirt 24 tends to be compressed, and in resisting this compression provides a spring biasing force which resists downward or inward movement of the base and urges the base upward relative to the container. This spring force functions in connection with the latching of the base to the container, as will be described subsequently.

Figure 5:
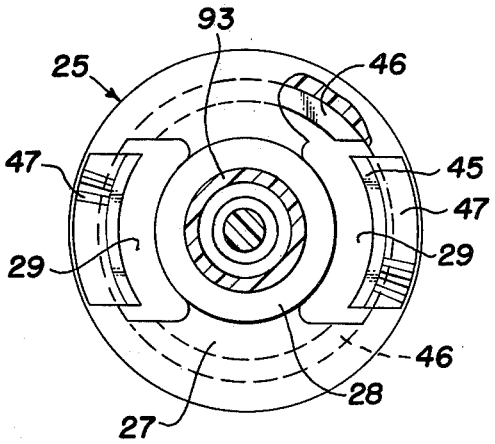
FIG. 5 is a fragmentary bottom view of the pump as viewed from the plane 5—5 of FIG. 3.

The base further includes a support barrel 25 which depends from the top wall 21 and is concentric with the skirts 22 and 24. This support barrel includes an outer cylindrical wall 26, a transverse connecting wall 27, and a tubular valve housing 28. The tubular housing 28 is supported concentrically with the cylindrical wall 26 by the connecting wall 27. The connecting wall includes openings 29 at opposite sides thereof, as best seen in FIG. 5 which function as latching recesses in the manner to be described.

A vent opening having a raised mouth 31 communicates with the annular space between the skirt 24 and cylindrical wall 26. The base also includes a hand rest provided by a lateral extension of the top wall 21 and support gussets 32.

Integral structural parts of the head 40 include a body 41, a support stem 42, a plunger 43, and a latching fin 44. The support stem includes a generally cylindrical sleeve, dependent from the body, which is divided into opposed latching fingers 45 and intermediate opposed fingers 46 at its distal end. The distal ends of the latching fingers 45 terminate in laterally projecting dogs 47. The support stem 42 is dimensioned fora snug fit within the support barrel wall 26; and, in assembled relation, the latching fingers 45 extend through the base wall openings 29 so that the dogs 47 latch at the distal edge of the wall 26. It will be seen then that disassembly of the base and head can be effected only by compressing the exposed ends of the latching fingers 45 relative to the cylindrical wall 26. The stem 42 is provided with an annular groove 48 adjacent its proximal end, to receive an O-ring seal between the stem and the cylindrical wall 26. The stem 42 also provides an interior cylindrical recess 49 to receive the upper end of the tubular housing 28 in sealing relation.

The body 41 includes an inlet chamber 50 which communicates with the interior of the support stem 42, and with the interior of the hollow plunger 43 by means of a tapered inlet passage 51. The plunger 43 is a tubular member projecting laterally from the body 41 having a pistion cup 54 formed at its distal end and an adjacent annular groove 53 for an O-ring seal with the actuator 60.

Figure 2:
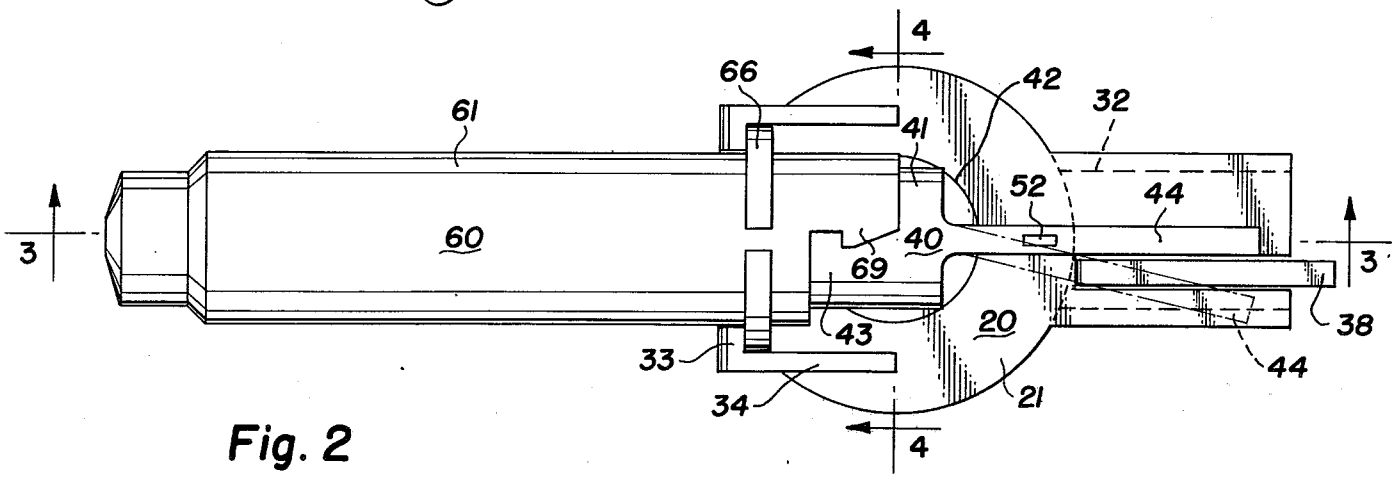
FIG. 2 is a top view of the pump of FIG. 1.
Figure 3:
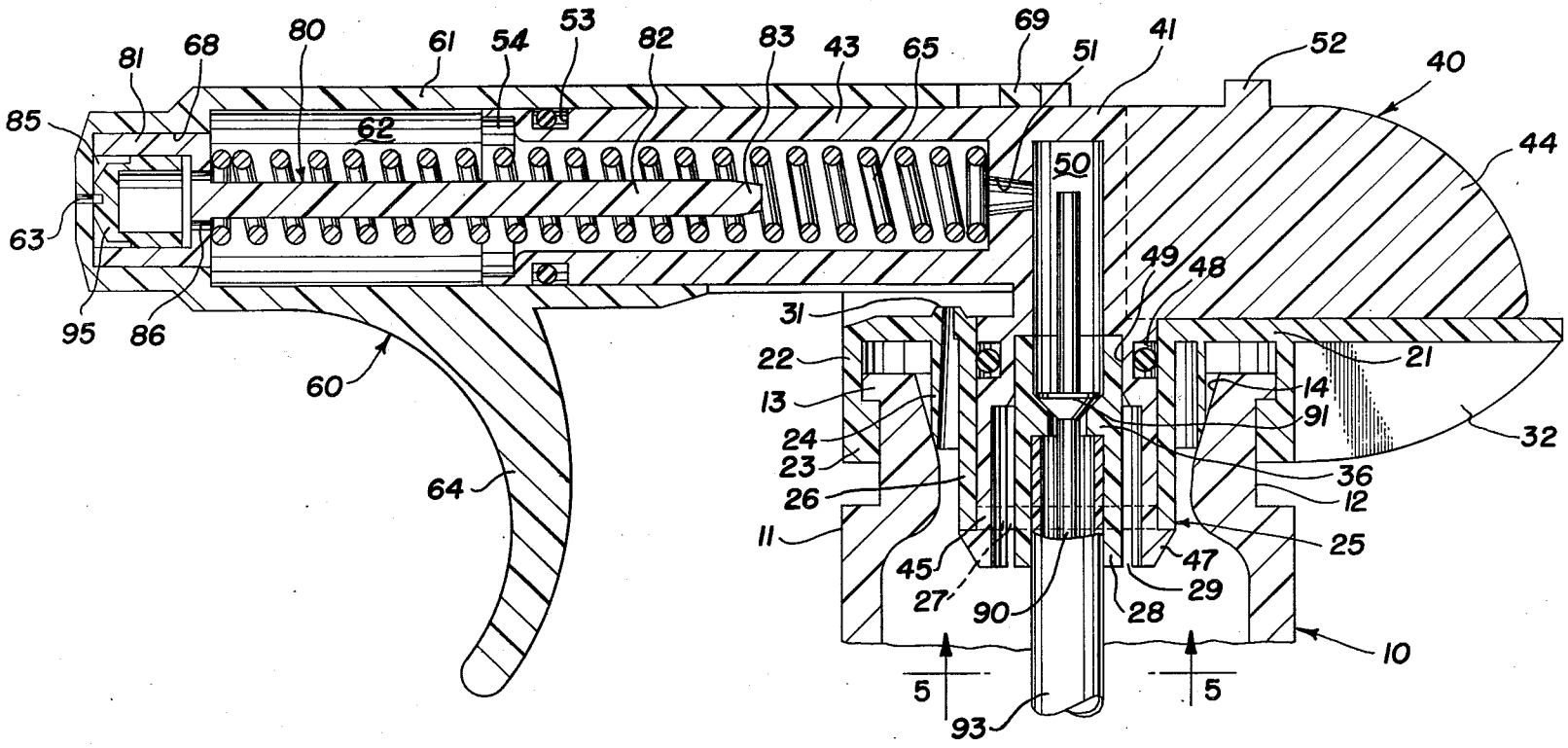
FIG. 3 is a longitudinal sectional view taken in the plane 3—3 of FIG. 2.
Figure 4:
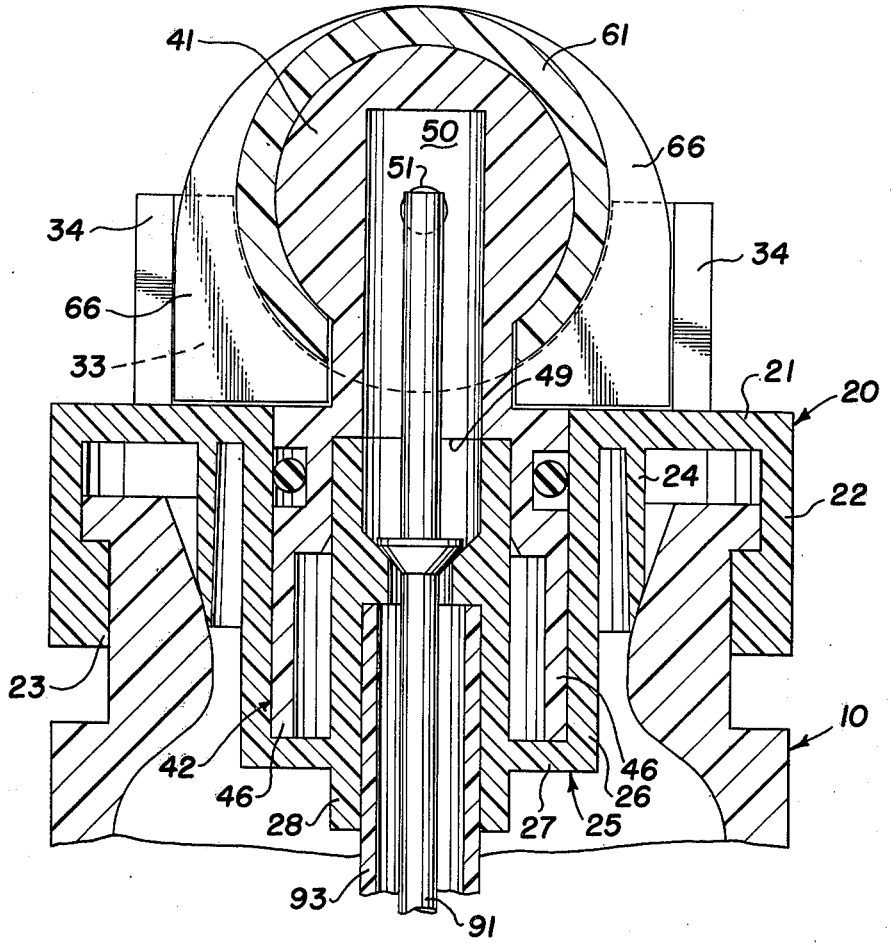
FIG. 4 is a transverse sectional view taken in the plane 4—4 of FIG. 2.

The actuator 60 consists principally of a barrel 61 having an internal cylindrical bore dimensioned to be closely recieved over the plunger 43, with the barrel and plunger defining a variable pump chamber 62. A discharge orifice 63 is provided at the distal end of the barrel. The actuator includes an integral trigger shaped handle 64 to be gripped by the user for moving the actuator toward the head body. A compression spring 65, disposed within the pump chamber 62, urges the actuator away from the pump body; and the actuator barrel includes limit flanges 66 adjacent to its proximal end coacting with a stop structure on the base 20 to limit outward movement of the actuator. This base stop structure, as best seen in FIGS. 1, 2 and 4, includes a stop lip 33 projecting upward from the top wall 21 and supported by gussets 34. In FIGS. 1, 2 and 3 the pump is shown in "pumping condition," with the actuator extended; and in FIG. 7 the pump is illustrated in the "locked condition" to be described.

Figure 6:
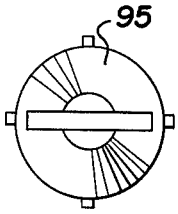
FIG. 6 is an end view of the outlet check valve.
Figure 7:
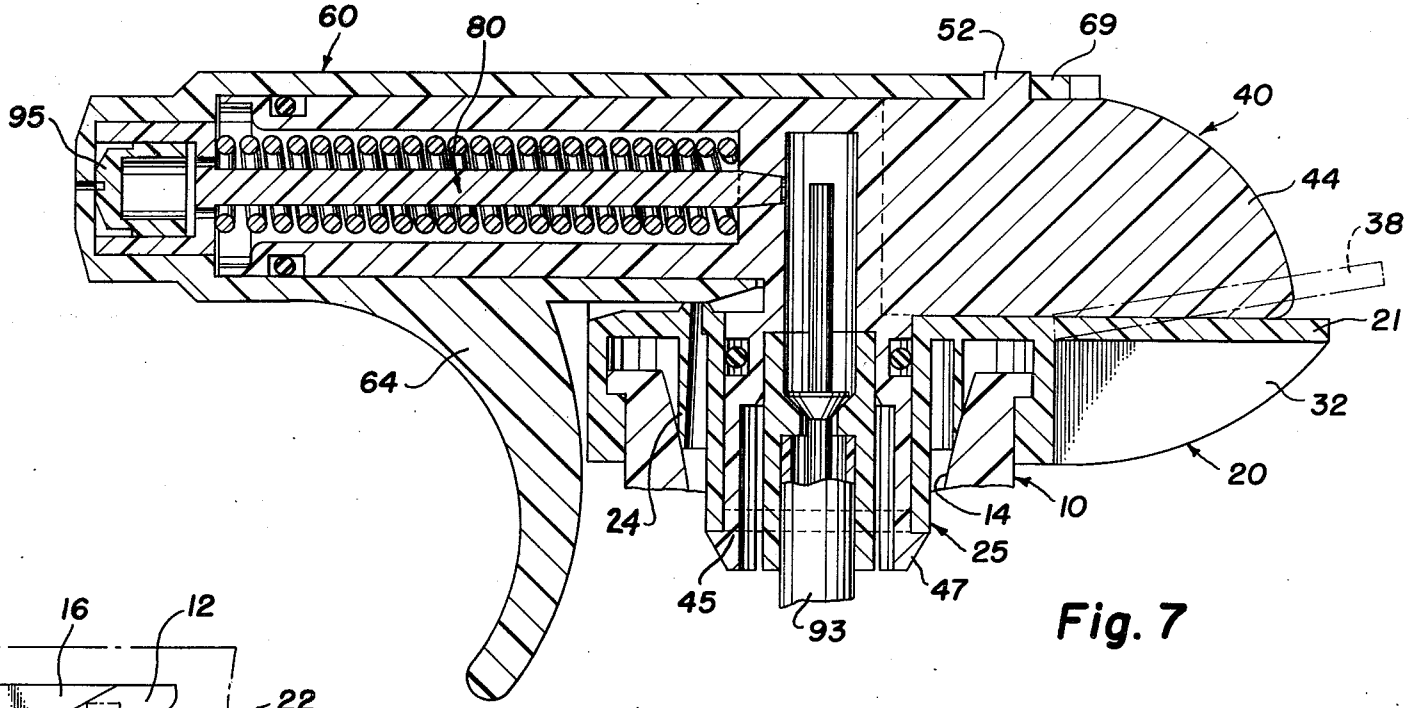
FIG. 7 is a sectional view, similar to FIG. 3, illustrating the pump in the locked condition.

A plug 80, for plugging the tapered passage 51, consists of a cup-shaped head 81 and an elongated stem 82 terminating in a tapered plug tip 83 at its distal end. The head 81 is dimensioned to be tightly received in a recess 68 at the distal end of the actuator barrel, with the open end of the head communicating with the discharge orifice 63. The head 81, together with the barrel, defines a chamber 85 for an outlet check valve 95; and passages 86 in the head communicate with valve chamber with the pumping chamber 62. The stem is coaxial with the barrel 61 and plunger 43; and the tapered plug tip 83 is dimensioned to enter the tapered inlet passage 51 to plug that passage, when the actuator is in the locked condition as best seen in FIG. 7. The outlet check valve 95 functions to close the passages 86, to prevent flow of air into the pumping chamber during the expansion stroke of the actuator 60; and functions to distribute fluid from the pumping chmaber 62 to the discharge orifice 63 on the compression stroke of the actuator. The face of the outlet valve 95 is illustrated in FIG. 6.

The inlet valve structure includes a valve seat 36, formed within the tubular housing 28 by an internal annular flange providing an upward facing conical seat. The chamber above this seat communicates with the head inlet chamber 50; and the chamber below the seat provides a recess for receiving the upper end of the dip tube 93 which may be a rigid or flexible plastic conduit extending to the bottom of the container 10. The inlet valve closure member 90 consists of an elongate stem, having an integral conical closure enlargement 91 intermediate its ends for coacting with the valve seat 36. The elongated stem extends upward into the inlet chamber 50 and downward into the dip tube 93.

Very briefly, the pumping action occurs as follows, assuming that the pumping chamber 62 is substantially filled with liquid. The user grasps the pump-container assembly about the neck of the container 10 with the hand resting against the head rest 32 and grips the trigger handle 64. By drawing the actuator 60 toward the container, the discharge stroke is effected to reduce the size of the pumping chamber 62. This seats the inlet valve 91 causing liquid to flow through the passages 86 into the outlet check valve chamber 85 and through the discharge orifice 63. When the trigger 64 is released by the user, the expansion or suction stroke of the actuator is effected by the spring 65. The initial flow of air into the discharge orifice 63 causes the check valve 95 to seat and seal the passages 86, thereby sealing the pumping chamber from the atmosphere. The continued suction stroke reduces pressure causing liquid to flow from the container through the dip tube 93, past the inlet valve 91, and through the inlet chamber 50 and passage 51 into the pumping chamber 62. The vent 31 allows atmospheric pressure to be maintained within the container 10, thereby effecting the flow of liquid to the pumping chamber. When the suction stroke is completed, the inlet valve 91 will seat by gravity preventing flow of liquid back into the container 10.

Locked Condition of the Pump

The pump base 20, head 40 and actuator 60 have coacting latching structure for securing the actuator in a "lock condition," illustrated in FIG. 7, in which the passage 51 is sealed by the plug tip 83 and in which the vent 31 is sealed by the plunger barrel. This locked condition may be a "shipping condition," wherein the container and attached pump are shipped in assembled relation and in which leakage of liquid from the container is prevented. This locked condition is also a "safety condition" in which the pump can be placed after use, and the pump is designed to inhibit or discourage operation of the pump by children in the event that a toxic or harmful liquid is contained in the container.

One form of this coacting latching structure is particularly illustrated in FIGS. 1 and 2. It will be seen that the latching fin 44 is a relatively thin member attached to the body 41 in the manner that it can be deflected laterally; and this fin carries an upward projecting latching lug 52. For coaction with this latching lug, the proximal end of the plunger barrel provides a latching dog 69 which engages the latching lug to retain the plunger in the locked condition of FIG. 7. To effect this latching, the latching fin 44 must be moved toward the phantom line position in FIG. 2; and before this can occur a limit finger 38 must be moved out of the illustrated interference position. As seen, this finger 38 is formed as part of the base top wall 21, and projects beyond the distal end of the hand rest portion to enable ready deflection by the user. FIG. 1 illustrates the finger 38 in the normal position where it extends above the surface of the base top wall 21 and, in that position, prevents lateral movement of the latching fin 44 in one direction as seen best in FIG. 2. When the finger 38 is depressed to the plane of the top wall 21, the latching fin can be moved toward the phantom line position seen in FIG. 2 to effect either engagement or disengagement of the lug 52 and dog 69. From the standpoint of safety, it will be seen that in order to disengage the plunger from the locked condition the user must depress the finger 38 and simultaneously move the latching fin 44 to disengage the lug 52 from the dog 69. Since small children will find this difficult to do with one hand while holding the pump in the other hand, it is unlikely that a child will be able to release the plunger in order to make the pump operative. An accompanying safety feature, to be described, is the safety latch relationship between the base 20 and container 10 to deter removal of the pump from the container by small children.

Figure 8:
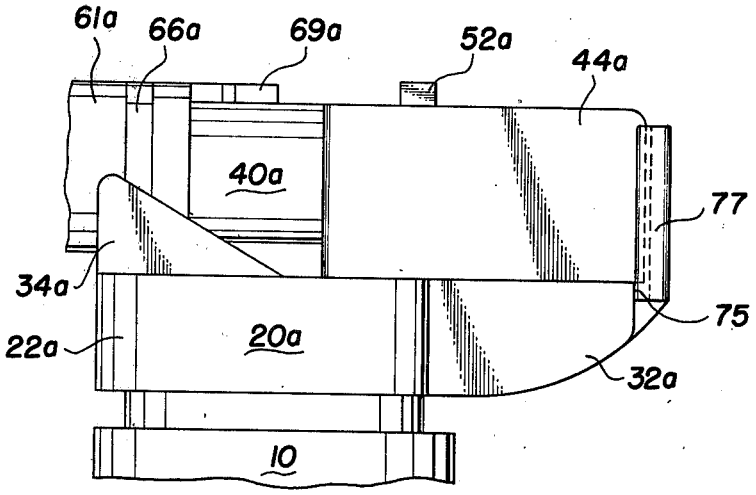
FIG. 8 is a fragmentary side elevation view of an alternative form of pump.
Figure 9:
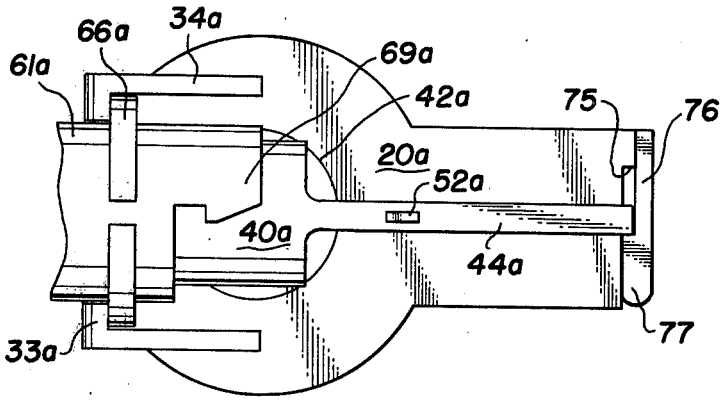
FIG. 9 is a fragmentary top view of the pump of FIG. 8.
Figure 10:
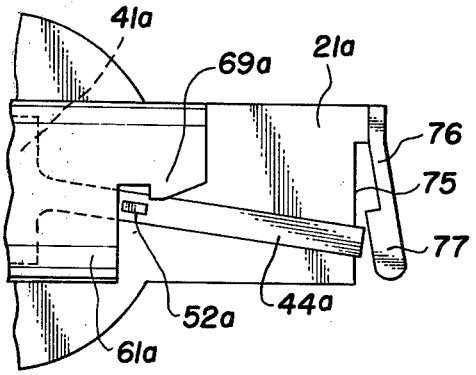
FIG. 10 is a fragmentary top view of the pump of FIG. 8 illustrating alternative positions of certain parts.

FIGS. 8, 9 and 10 illustrate alternative coacting structure of the pump base, head and actuator for latching the actuator and for effecting release of the actuator to the pumping position; FIGS. 8 and 9 being fragmentary views corresponding to FIGS. 1 and 2 respectively. In these views corresponding parts of the pump assembly are designated by the same reference numbers with the subscript "a." In this arrangement the body latching fin **44*a* and its latching lug 52*a* coact with the latching dog 69*a* of the plunger barrel 61*a* in the same manner previously described. The structure for restraining the lateral movement of the latching fin 44*a* is different. As best seen in FIGS. 9 and 10, the base top wall extension 21*a* is provided with a notch 75 at its distal end; and an upward extending flap 76 is integrally attached to the wall 21 at one corner, adjacent to the notch. The flap overlies the notch, and is deflectable about a vertical hinge axis away from the distal end of the latching fin 44*a*. The flap 76 includes a dog 77 for engaging the distal end of the latching fin 44*a***.

FIGS. 8 and 9 illustrate the flap 76 in the normal position, wherein the latching fin **44*a* is in its normal position and is prevented from moving in one direction, that is, in the direction to provide for engagement or disengagement of the lug 52*a* and dog 69*a*. In order to allow latching or unlatching movement of the latching fin 44*a*, the flap 76 must be deflected outwardly by the user as illustrated in FIG. 10. Again, from the safety standpoint assuming that the pump is in the locked condition, the user must move the flap 76 and the latching fin 44*a* to the positions indicated in FIG. 10** substantially simultaneously; and this must be done with one hand while the pump assembly and container are held in the other hand. It is unlikely that younger children will be able to do this.

Pump-Container Safety Closure

The above described pump can be used with any style or size of container; and the closure defined by the base top wall 21 and closure 22 may have any desired configuration for coaction with the complementary configuration of the neck of the container. The drawings illustrate a particular form of coacting closure between the pump and container which functions to seal the pump to the container in the desired manner, and which also functions as a safety closure designed to inhibit or discourage removal of the pump from the container by children.

Figure 12:
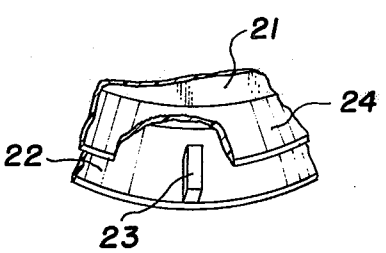
FIG. 12 is a fragmentary view of the interior of the pump closure illustrating a latching lug.
Figure 11:
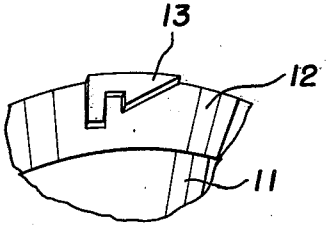
FIG. 11 is a fragmentary view of the container neck illustrating a latching dog.
Figure 13:
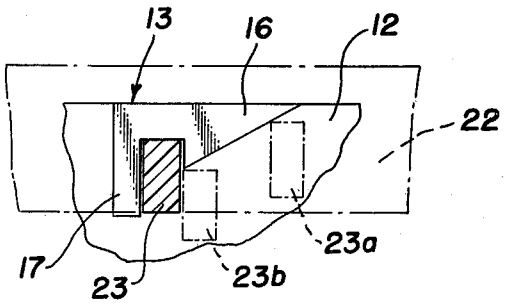
FIG. 13 is a detail view illustrating the latching of the pump closure and container.

Referring to the drawings the generally cylindrical exterior surface 12 of the container neck 11 includes a plurality (four or six, for example) of latching dogs 13 spaced equally about the lip of the container. The configuration of these dogs is particularly illustrated in FIGS. 11 and 13; FIG. 11 being a fragmentary view of the exterior of the container mouth, and FIG. 13 being a similar view with relative positions of the closure latching lugs 23 superimposed. As best seen in FIG. 13, the latching dog 13 includes a cam portion 16, a stop portion 17, and intermediate latching recess. FIG. 12 is a fragmentary view looking at the interior of the base closure skirt 22 illustrating the position of a latching lug 23 thereon. The number of latching lugs 23 will be the same as the number of latching dogs 13. It will be seen that the latching lugs are generally rectangular in cross-section and dimensioned to be received in the latching recess as best seen in FIG. 13.

As previously described, the coaction of the interior skirt 24 of the base 20 and of the tapered wall surface 14 of the container 10 provide an axial spring biasing force which tends to resist movement of the pump base toward the container. It is this biasing force together with the coaction of the latching lugs and dogs which provides the safety closure feature. With particular reference to FIG. 13, it will be seen that when the closure base 20 is placed over the container mouth, the latching lugs 23 will be received between the latching dogs 13. Then as the base is rotated clockwise relative to the container 10, the lugs 23 engage the dog cam surfaces 16 as indicated by the phantom line position 23*a* in FIG. 13. With continued rotation, the camming action will move the lugs and base downward against the resisting action of the biasing force, until the lugs reach the position indicated by the phantom line 23*b* in FIG. 13. With continued rotation the lugs are moved into alignment with the dog recesses and the biasing force will move the lugs into the latched condition illustrated by the lug 23 in FIG. 13. The stop portions 17 prevent excessive relative rotation of these parts.

It will be seen then that simple, relative counterclockwise rotation will not effect removal of the pump base from the container. The counterclockwise rotation must be accompanied by an axial force countering the biasing force, to release the latching lugs 23 from the latching dog recesses. With suitable design this force will be such that the operation is difficult to perform by children, thereby inhibiting or discouraging removal of the pump assembly from the container. THis closure-container design is suitable as a safety closure for the above described pump and, coupled with the safety feature of the pump as described, provides an overall assembly of pump and container which is safe for use with liquids that may be a hazard to children.

Features and Advantages

What has been described is a unique dispensing pump for use with liquid containers which is fabricated from three basic components adapted to be fabricated from suitable plastic materials by high speed, economic injection molding techniques. The three basic components, as well as other subcomponents are readily assembled together; and are also readily disassembled, if desired, provided access is had to the underside or interior of the base closure. In other words, the pump cannot be disassembled without removing the pump from the container.

A feature and advantage of the pump assembly is that all of the parts, with the possible exception of the compression spring, may be fabricated from plastic materials by injection molding techniques.

A particular feature and advantage of the pump is that the basic parts include latching structure for placing the pump in the "locked condition," in which the pump and the necessary vent opening in the pump base are sealed to prevent leakage of liquid from the assembly of pump and container. This feature is independent of the type of closure that is provided for coaction with the neck of the container. This feature enables shipping of the pump and container assembled, with the pump functioning as a primary-seal unit and obviating the necessity of packaging the pump along side the container with another closure used as the primary seal. This feature also enables the placing of the pump-container assembly in locked condition following use, to prevent leakage of liquid in the event that the assembly is overturned on a storage shelf for example.

Another important feature and advantage of the pump is that this latching structure is provided not only for placing the pump in the above mentioned locked condition, but that this structure is designed to inhibit or discourage release of the pump from the locked condition by children, and therefore the pump is a safety pump enabling use with hazardous liquids. Two alternative designs are described which require that while the pump-container assembly is held in one hand of a child for example, the child must perform simultaneously with the other hand two separate operations to effect release of the actuator.

An accompanying feature of the pump container assembly, is that the pump closure and the mouth of the container are provided with coacting latching structure providing a safety closure which inhibits or discourages removal of the pump from the container. This safety design is also such that the coacting structure of the pump closure and container mouth provide a liquid tight seal. The combination of the safety closure with the container and the safety pump, in the locked condition, provides a truly safe pump-container assembly, with respect to possible harm to children which could otherwise result from tampering with the assembly.

While preferred embodiments of the invention have been illustrated and described, it will be understood by those skilled in that art that changes and modifications may be resorted to without departing from the spirit and scope of the invention.

What is claimed is:

1. A dispensing pump in combination with a container for liquid comprising, in combination, a base comprising a closure, for sealing engagement with a container mouth, and a central support barrel coaxial with said closure and the container mouth;

a head comprising a body and a depending, hollow support stem, said stem coacting with said support barrel to support said head on said base; said body having means defining an inlet chamber, communicating with said hollow support system; and an elongated hollow plunger projecting laterally from said body, communicating with said inlet chamber;

an actuator comprising a hollow barrel slidably received over said hollow plunger, to define therewith a variable pump chamber; a spring disposed in said pump chamber urging outward movement of said actuator relative to said head; said actuator barrel having a discharge orifice at its distal end;

said base closure being cup-shaped, having an outer cylindrical skirt for receiving and enclosing a portion of a container neck, said skirt wall having interior peripherally spaced latching lugs for engagement with complementary latching dogs carried by said container; and said closure having spring means coacting with said container urging said closure axially away from said container to engage said lugs with said dogs; and said lugs being disengageable from said dogs with axial movement of said closure toward said container accompanied by rotational movement;

said container having a generally cylindrical neck provided with a tapered interior surface adjacent to its mouth, and provided with said latching dogs peripherally spaced on its outer surface; said tapered surface reducing in diameter toward its inner end;

said base closure spring means including a generally cylindrical interior skirt projecting from its top wall generally coaxial with said outer skirt; the distal edge of said interior skirt dimensioned to engage said container tapered surface, whereby axial movement of said closure toward said container effects compression of said interior skirt and resultant resistance to said axial movement providing a spring effect;

said head body having a latching lug said actuator having a latching dog disposed to engage and latch with said latching lug when said actuator is retracted to a lock position.

2. A pump as set forth in claim 1 said support barrel comprising a cylindrical wall and means defining a base wall at its distal end; said support barrel having circumferentially spaced latching recess means disposed adjacent to its distal end;

said head support stem comprising a hollow cylindrical sleeve dimensioned to be slidably received within said support barrel;

said sleeve including angularly spaced resilient, longitudinal fingers having latching dogs at their distal ends; said dogs being disposed to engage and latch with said support barrel latching recess means.

3. A pump as set forth in claim 2 said base wall having openings at its edges adjacent to said cylindrical wall, defining said latching recess means;

said stem fingers being configured and disposed to extend through said base wall openings for latching engagement with the distal edge of said support barrel cylindrical wall.

4. A pump as set forth in claim 1 said support barrel comprising a cylindrical wall and means defining a base wall at its distal end; and a tubular valve housing supported by said base wall coaxial with said cylindrical wall;

said valve housing providing valve seat means for an inlet check valve, and providing means for supporting a dip tube;

said head support stem comprising a cylindrical sleeve received between said support barrel and said valve housing, to effect a seal between said pump base and said pump head.

5. A pump as set forth in claim 1 said interior skirt presenting an imperforate cylindrical wall and an annular distal edge; and said interior skirt coacting with said container tapered mouth surface to provide a seal between said base closure and said container.

6. A pump as set forth in claim 1 said head having passage means communicating said inlet chamber and said hollow plunger; an elongated stem mounted at the distal end of said actuator barrel and extending coaxially within said actuator barrel toward the proximal end thereof; and the distal end of said stem defining a plug for closing said inlet passage in the lock position of said actuator.

7. A pump as set forth in claim 1 said base closure having a vent passage, with an exterior mouth at the upper surface thereof; said actuator having a seal surface disposed to engage and seal said vent mouth in the lock position of said actuator.

8. A dispensing pump for use with a container for liquid comprising, in combination, a base comprising a closure, for sealing engagement with a container mouth, and a central support barrel coaxial with said closure and the container mouth;

a head comprising a body and a depending, hollow support stem, said stem coacting with said support barrel to support said head on said base; said body having means defining an inlet chamber, communicating with said hollow support stem; and an elongated hollow plunger projecting laterally from said body, communicating with said inlet chamber;

an actuator comprising a hollow barrel slidably received over said hollow plunger, to define therewith a variable pump chamber; a spring disposed in said pump chamber urging outward movement of said actuator relative to said head; said actuator barrel having a discharge orifice at its distal end;

said base and said actuator having coacting stop means to limit outward movement of said actuator relative to said head; and handle means on said actuator for effecting inward movement thereof by the user;

said head body having a latching lug; said actuator having a latching dog disposed to engage and latch with said latching lug when said actuator is retracted to a lock position.

9. A pump as set forth in claim 8 said base closure having a vent passage, with an exterior mouth at the upper surface thereof; said actuator having a seal surface disposed to engage and seal said vent mouth in the lock position of said actuator.

10. A pump as set forth in claim 8 said head having passage means communicating said inlet chamber and said hollow plunger; an elongated stem mounted at the distal end of said actuator barrel and extending coaxially within said actuator barrel toward the proximal end thereof and the distal end of said stem defining a plug for closing said inlet passage in the lock position of said actuator.

11. A pump as set forth in claim 10 said head having a flexible latch fin extending laterally from said body in a direction opposite from said plunger; and said latching lug projecting from said fin whereby the flexibility of said fin enables the latching of said lug with said latch dog.

12. A pump as set forth in claim 11 said head body projecting upward from said base closure; said head fin projecting laterally from said head body; and a resilient limit member mounted on said closure, disposed contiguous to said fin at one side thereof to prevent lateral movement of said fin in one direction, said movement of said fin in said one direction serving to disengage said fin latching lug from said plunger latching dog; and said limit member being selectively movable to permit said movement of said fin in said one direction.

13. A pump as set forth in claim 12 said closure presenting a generally horizontal top surface underlying said fin; said fin presenting a generally horizontal undersurface contiguous to said closure top surface; said limit member comprising a longitudinal finger formed at its inner end to said closure in the plane of said top surface, extending generally parallel to said fin in its normal position with its distal end projecting beyond said fin; a portion of said limit finger normally disposed above said closure top surface to limit movement of said fin toward said finger; and said finger being deflectable to the plane of said closure top surface to permit deflection of said fin over said finger.

14. A pump as set forth in claim 12 said closure including a lateral projection presenting a generally horizontal top surface underlying said fin; said fin presenting a horizontal undersurface contiguous to said closure top surface; said limit member comprising a flap fixed at one end to one side of said closure projection at its distal end, and having a dog at its distal end for engagement with said fin to limit movement of said fin in the direction, and said flap being deflectable to permit movement of said fin in said one direction.

* * * * *